US005783543A

United States Patent [19]

Fleckenstein et al.

[11] Patent Number: 5,783,543

[45] Date of Patent: Jul. 21, 1998

[54] SCATTERABLE CARPET CLEANING FORMULATION CONTAINING ROLLABLE PARTICLES

[75] Inventors: Theo Fleckenstein, Hilden; Alexander Ditze, Remscheid; Franz Kresse, Hilden; Thomas Hahn, Duesseldorf, all of Germany

[73] Assignee: Henkel Kommanditgesellschaft auf Aktien, Duesseldorf, Germany

[21] Appl. No.: 718,557

[22] PCT Filed: Mar. 21, 1995

[86] PCT No.: PCT/EP95/01040

§ 371 Date: Oct. 30, 1996

§ 102(e) Date: Oct. 30, 1996

[87] PCT Pub. No.: WO95/27023

PCT Pub. Date: Oct. 12, 1995

[30] Foreign Application Priority Data

Mar. 30, 1994 [DE] Germany ..... 44 11 047.2

[51] Int. Cl.[6] ..... C11D 3/382; C11D 1/14; B08B 3/04

[52] U.S. Cl. ..... 510/280; 514/277; 514/278; 514/279; 514/418; 510/473; 510/462; 510/344; 510/474; 510/511; 510/508; 510/357; 510/351; 510/352; 510/475; 510/397; 8/137

[58] Field of Search ..... 510/280, 277, 510/278, 279, 418, 473, 462, 344, 474, 511, 508, 357, 351, 352, 475, 397; 8/139, 137

[56] References Cited

U.S. PATENT DOCUMENTS

| | | | |
|---|---|---|---|
| 4,659,494 | 4/1987 | Soldanski et al. | 252/88 |
| 4,834,900 | 5/1989 | Soldanski et al. | 252/88 |
| 5,286,400 | 2/1994 | Paszek et al. | 252/88 |
| 5,391,316 | 2/1995 | Garrett et al. | 252/126 |
| 5,683,976 | 11/1997 | Colurciello, Jr. et al. | 510/278 |
| 5,714,449 | 2/1998 | Donker et al. | 510/304 |

FOREIGN PATENT DOCUMENTS

| | | |
|---|---|---|
| 2013120 | 10/1990 | Canada . |
| 178 566 | 4/1986 | European Pat. Off. . |
| 392 248 | 10/1990 | European Pat. Off. . |
| 34 37 629 | 4/1986 | Germany . |
| 38 42 152 | 6/1990 | Germany . |
| 40 27 004 | 3/1992 | Germany . |
| WO 90/06985 | 6/1990 | WIPO . |

*Primary Examiner*—Douglas J. McGinty
*Attorney, Agent, or Firm*—Ernest G. Szoke; Wayne C. Jaeschke; Steven J. Trzaska

[57] ABSTRACT

A carpet cleaning composition comprising: (a) a powder-form solid adsorbent; (b) rollable particles of porous material, each particle having a length greater than 1 mm, and a diameter equal to at least 10% of the length of the particle; and (c) water.

11 Claims, No Drawings

SCATTERABLE CARPET CLEANING FORMULATION CONTAINING ROLLABLE PARTICLES

BACKGROUND OF THE INVENTION

1. Field of the Invention

This invention relates to scatterable cleaning formulations for textiles.

2. Discussion of Related Art

In addition to shampoos, powder-form cleaners above all are used for cleaning certain textiles, such as carpets and upholstery, which generally are not accessible to washing and, accordingly, are cleaned in situ. These powder-form cleaners, which are also known as dry-cleaning compositions, consist of a solid which acts as an adsorbent and a volatile liquid which is incorporated in the adsorbent and of which the function is to partly dissolve the soil on the textile. For cleaning, these formulations are scattered onto the textiles and, after evaporation of the liquid, are removed from the textile together with the soil constituents, which have been deposited onto the adsorbent, either by brushing or by vacuum cleaning. Numerous substances have been proposed in the literature both as adsorbents and as liquids for these formulations. Thus, natural polymers, such as wood flour, starch and cork powder, inorganic materials, such as kieselguhr and bentonite, and various synthetic organic polymers in powder form have been proposed as adsorbents. Organic solvents, such as gasoline or chlorinated hydrocarbons, and aqueous surfactant solutions or water/alcohol mixtures have been mentioned as suitable cleaning liquids, cf. for example DE-OSS 38 42 152, 34 37 629 and 40 27 004, which describe the use of relatively large-surface synthetic polymer particles or short-fiber cellulose in conjunction with aqueous or non-aqueous cleaning liquids.

An adequate cleaning effect is only obtained with dry cleaning formulations when, after scattering on, they are worked into the carpet by manual or machine brushing so that they come into contact with all the soil-bearing fibers. Because of the forces applied, the brushing in of the cleaning powder imposes particular demands on the strength of the carpet fibers. In many cases, roughening of the surface and the loss of carpet fibers cannot be avoided. Fluff is formed and, in certain circumstances, even impedes working in of the powder itself because some of the loose fibers wrap themselves around the lower end of the brush so that the brushing-in process has to be interrupted.

Surprisingly, the problems mentioned above are avoided if relatively large porous and rollable particles are added to the carpet cleaning formulations based on powder-form adsorbents.

DESCRIPTION OF THE INVENTION

Accordingly, the present invention relates to a carpet cleaning formulation in the form of a scatterable composition which contains an aqueous cleaning liquid, a solid powder-form adsorbent and, in addition, rollable particles of porous material, the longest dimension of these particles being more than 1 mm and up to 50 mm and the dimensions in two other spatial directions, which are perpendicular to one another and to that length, being at least 10% of this maximum length. Particularly preferred carpet cleaning formulations are those in which the rollable particles consist of a deformable material, more particularly an absorbent sponge-like material.

The presence of rollable particles reduces the wear and tear on the carpet during working-in of the scatterable formulation without any significant reduction in cleaning performance. The formation of fluff is reduced. Loose fibers and similar material, for example hairs lying on the carpet, are rolled around the particles and, accordingly, can no longer lead to clogging of the brush and hence to interruption of the working-in process. In addition, odors emitted during the cleaning process can be effectively masked by the incorporation of suitable fragrances in the porous rollable particles. Since the carpet cleaning formulation, including the rollable particles, can be completely removed by vacuum cleaning after drying, only small amounts of perfume are left on the carpet after cleaning so that only a faint odor remains. Instead of this, the bag of the vacuum cleaner is being provided to an increasing extent with a slow-release fragrance, which is desirable in many cases. The positive properties, which the scatterable cleaning formulations acquire through the addition of the rollable particles, are largely independent of the constituent material of the rollable particles. Neither are the advantages confined to the choice of special powder-form adsorbents, instead they appear to be in evidence with all the powder-form adsorbents used for scatterable carpet cleaning formulations.

Accordingly, suitable powder-form adsorbents for the carpet cleaning formulations according to the invention are, for example, wood flour in bleached and unbleached form, cellulose powder, starch, cork powder, synthetic organic polymers in powder form, such as polyethylene powder, polypropylene powder, polyurethane powder, polystyrene powder, the term "powder" in this context also encompassing fine-particle polymer fibers and ground polymer foams, for example ground polyurethane foam, ground polystyrene foam, ground urea/formaldehyde resin foam and ground phenolic resin foam. Inorganic materials may also be used as powder-form adsorbents, including for example silicon dioxide in various forms, such as precipitated silica, kieselguhr and even fine sand, aluminium oxide in powder form, ground pumice stone, aluminas, for example bentonite, and other aluminium silicates, for example zeolites X, Y and A, faujasite and hydrotalcite, also ground foam glass and fine-particle soluble salts, such as sodium borate and sodium chloride. The particle size of these powder-form adsorbents is preferably between about 0.01 mm and 1 mm and more preferably between 0.02 and 0.3 mm. Adsorbents from the group consisting of wood flour, cellulose powder, water-insoluble cellulose derivatives, silica, zeolite, ground polyurethane foam and ground urea/formaldehyde resin foam are preferred.

The rollable particles present in the formulations according to the invention may be regularly or irregularly shaped particles. The crucial aspect is that the shape of the particles should be such that, during working-in of the carpet cleaning formulation, the particles are able to roll under the brush swept over the carpet. Accordingly, suitable particle shapes are spheres, cylinders, ellipsoids, egg shapes or even irregular shapes such as are formed, for example, by agglomeration of relatively small particles into granules. However, in the case of elastic and readily deformable materials in particular, even relatively angular particles, including cubes and squares, can be rollable and hence suitable for the formulations according to the invention. The size of the rollable particles should on average be distinctly larger than the particle size of the powder-form adsorbents. Thus, the longest spatial dimension of the particles should be more than 1 mm and preferably more than 3 mm and may be up to 50 mm and preferably up to 10 mm. In the two other spatial directions, which are perpendicular to one another and to that length, the particle dimensions should be at least 10% and preferably at least 20% of this maximum length.

The rollable particles may consist of various materials. Suitable materials are, for example, wood, vegetable fibers, such as coconut fibers, cellulose and cotton linters, cork, rubber, light-colored peat, starch and starch products, for example from the production of cereals, up to and including barley roots, a waste product from malt factories. Suitable synthetic organic materials are, for example, polyvinyl acetate, polyvinyl alcohol, polyvinyl chloride, polyethylene, polypropylene, polystyrene, polyurethane, polyacrylate, polyester, polycarbonate, polyamide and polysiloxane. Suitable inorganic materials are various silicates, silica in various forms, aluminium oxide, aluminium silicates, for example zeolites X, Y and A, faujasite and hydrotalcite and also foam glass. The rollable particles preferably consist predominantly or completely of cellulose, viscose, natural sponge or open-cell foam plastics.

The particles can be produced on the one hand by size-reduction of relatively large pieces of material, for example by cutting up or by grinding, or on the other hand by agglomeration of fine-particle materials by various agglomeration techniques. More particularly, the particles of wood, cork, peat and natural sponge and the particles of synthetic organic polymers are generally obtained by size reduction of relatively large pieces. The particles consisting of synthetic organic polymers are preferably obtained from foamed material or from fleece-like material or from pieces of fabric. Foam glass is also preferably brought to the required size by size reduction. By contrast, the other inorganic materials mentioned and also starch- and cellulose-containing materials are advantageously converted into rollable particles of the required size by agglomeration of relatively fine particles. The choice of the agglomeration process and the binder materials necessary, if any, is of secondary importance. The macroscopic pore volume of the rollable particles is preferably between about 0.3 and 50 mug and more preferably between 1 and 30 ml/g.

The content of rollable particles in the formulations according to the invention can be relatively small because even a few particles are sufficient to obtain the required effect. Thus, the percentage content of rollable particles in the formulations according to the invention is preferably between about 0.1 and 10% by weight and more preferably between 0.1 and 2% by weight, based on the formulation as a whole.

In the most simple case, the cleaning liquid present in the formulations according to the invention may be water and only water although, in many cases, the cleaning liquid contains other auxiliaries which enhance the cleaning effect or are otherwise useful in the practical application of the formulations. The quantity of liquid is gauged in such a way that it can be taken up by the solid constituents of the formulations, thus guaranteeing their scatterability. For this reason, the content of water in the formulations is preferably from 25 to 75% by weight and more preferably from 30 to 70% by weight, based on the formulation as a whole.

The formulations according to the invention may advantageously contain organic solvents and/or surfactants as cleaning-enhancing additives in the cleaning liquid. Suitable organic solvents are both water-miscible and water-immiscible solvents providing they do not attack the textiles and are sufficiently volatile to evaporate in a short time after application of the formulations to the textiles. In addition, it is important when selecting the solvents to ensure that they have sufficiently high flashpoints in the final product mixture and are toxicologically safe. Suitable solvents are alcohols, ketones, glycol ethers and hydrocarbons, for example isopropanol, acetone, ethers of monoethylene and diethylene glycol and of mono-, di- and tripropylene glycol with boiling points of 120° C. to 250° C. and gasolines with a boiling range of 130° to 200° C., more particularly low-aromatic fractions, and mixtures of these solvents. $C_{2-3}$ alcohols, propylene glycol ethers, gasolines and mixtures thereof are preferably used. The quantity of organic solvents in the formulations according to the invention is preferably not more than 20% by weight and, in particular, between 2 and 15% by weight.

Although the formulations have a very good surface cleaning effect in no way inferior to that of commercial formulations, even without the addition of surfactants, the removal of stains can be further improved in the majority of cases by the addition of surfactants. In general, a surfactant addition of up to 10% by weight is sufficient. The formulations preferably contain 0.05 to 5% by weight and, more particularly, no more than 1% by weight of surfactants. Of the large number of known surfactants, substances which dry off to form a solid brittle residue, optionally together with other non-volatile constituents of the formulations, are particularly suitable. The surfactants may emanate from the classes of anionic or nonionic surfactants, although anionic surfactants are preferably used.

Suitable nonionic surfactants are, in particular, adducts of 1 to 30 and preferably 4 to 15 moles of ethylene oxide per mole of a long-chain compound containing 10 to 20 carbon atoms from the group of alcohols, alkylphenols, carboxylic acids and carboxylic acid amides. Corresponding compounds in which propylene oxide is added on instead of part of the ethylene oxide are also suitable. Of particular importance are the adducts of ethylene oxide with long-chain primary or secondary alcohols such as, for example, fatty alcohols or oxoalcohols and with monoalkylphenols or dialkylphenols containing 6 to 14 carbon atoms in the alkyl groups. Other suitable nonionic surfactants are the long-chain amine oxides and the fatty alkyl (poly)glycosides containing 1 to 3 glycose units in the molecule.

Particularly suitable anionic surfactants are those of the sulfate or sulfonate type, although other types, such as soaps, long-chain N-acyl sarcosinates, salts of fatty acid cyanamides or salt of ether carboxylic acids obtainable from long-chain alkyl or alkylphenyl polyglycol ethers and chloroacetic acid, may also be used. The anionic surfactants are preferably used in the form of the sodium salts.

Particularly suitable surfactants of the sulfate type are the sulfuric acid monoesters of long-chain $C_{10-20}$ primary alcohols of natural and synthetic origin, i.e. the sulfuric acid monoesters of fatty alcohols, for example cocofatty alcohols, tallow fatty alcohols, oleyl alcohol, or $C_{10-20}$ oxoalcohols and sulfuric acid monoesters of secondary alcohols with the same chain length. The sulfuric acid monoesters of aliphatic primary alcohols, secondary alcohols or alkylphenols ethoxylated with 1 to 6 moles of ethylene oxide are also suitable, as are sulfated fatty acid alkanolamides and sulfated fatty acid monoglycerides.

The surfactants of the sulfonate type are, primarily, sulfosuccinic acid monoesters and diesters containing 6 to 22 carbon atoms in the alcohol components, alkyl benzene sulfonates containing $C_{9-15}$ alkyl groups and esters of α-sulfofatty acids, for example the α-sulfonated methyl or ethyl esters of hydrogenated coconut oil, palm kernel oil or tallow fatty acids. Other suitable surfactants of the sulfonate type are the alkane sulfonates obtainable from $C_{12-18}$ alkanes by sulfochlorination or sulfoxidation and subsequent hydrolysis or neutralization or by bisulfite addition onto olefins and the olefin sulfonates, i.e. mixtures of alkene and hydroxyalkane sulfonates and also disulfonates obtained, for example, from long-chain monoolefins with a terminal or internal double bond by sulfonation with gaseous sulfur trioxide and subsequent alkaline or acidic hydrolysis of the sulfonation products.

$C_{12-18}$ fatty alcohol sulfates, salts of sulfosuccinic acid monoesters containing 16 to 20 carbon atoms in the alcohol component and mixtures of these surfactants are particularly preferred.

In addition to the components already mentioned, the formulations according to the present invention may also contain small quantities of other auxiliaries and additives typically encountered in textile and carpet cleaning compositions. Examples of such auxiliaries and additives are antistatic components, for example inorganic salts and quaternary ammonium compounds, optical brighteners, resoiling inhibitors, for example polyacrylates, additives which improve scatterability and dispersibility, preservatives and perfume. These auxiliaries and additives are normally used in total quantities of no more than 10% by weight, preferably in quantities of no more than 5% by weight and more preferably in quantities of 0.01 to 2% by weight, based on the formulation as a whole.

A particularly preferred formulation contains cellulose powder as the powder-form adsorbent, preferably in quantities of around 40 to 50% by weight, flakes of viscose sponge as the rollable particles, preferably in quantities of around 0.1 to 2% by weight, sodium olefin sulfonate as surfactant, preferably in quantities of around 0.2 to 1.5% by weight, low-aromatic gasoline as solvent, preferably in quantities of around 1 to 10% by weight, and water.

The production of the formulations according to the invention does not involve any significant outlay on equipment. Simple mixing units, such as blade or drum mixers are suitable, the rollable particles, the powder-form adsorbent and any other fine-particle solid components are initially introduced into the mixer and are then sprayed in motion with the cleaning liquid in which other constituents are optionally dissolved.

The textiles and carpets are cleaned by scattering the cleaning formulations according to the invention onto the textiles either by hand or by means of a suitable distributor and then rubbing them more or less intensively into the textiles, for example by means of a sponge, a brush or a board. In general, the working-in times are between 0.3 and 5 minutes and preferably between 0.5 and 3 minutes per square meter. The residues are mechanically removed from the textiles, for example by brushing and/or vacuum cleaning. For cleaning relatively large textile surfaces, the formulations according to the invention are applied in quantities of around 2 to around 150 g/m$^2$, depending on the fullness of the textiles and the degree of soiling, although considerably larger quantities may also be used in the treatment of relatively small pieces of textiles or for the removal of individual stains. For cleaning carpets, the formulations are normally applied in quantities of around 10 to around 100 g/m$^2$. The process as a whole may be carried out largely manually, for example in the home, although it is also possible to carry out rubbing in and, optionally, other steps by means of suitable machines, for example combined distributing and brushing machines, so that the process is equally suitable for use in the institutional sector.

EXAMPLES

The formulations listed with their individual components in the following Table were prepared in quantities of 10 kg in a paddle mixer, the adsorbents and the rollable particles being introduced first and then being sprayed with a solution of the other components in water. Mixing was continued until a homogeneous free-flowing product was formed.

TABLE

Composition of the Formulations (in % by weight)

| | 1 | 2 | 3 | 4 | 5 | 6 |
|---|---|---|---|---|---|---|
| Beechwood cellulose powder | 43.0 | 46.0 | 42.5 | 47.0 | | |
| Urea/formaldehyde resin foam, powdered (75% moisture) | | | | | 72.0 | 88.0 |
| Chopped viscose sponge | 0.3 | 0.6 | | 1.0 | 3.0 | |
| Zeolite agglomerate | | | 2.5 | | | 4.7 |
| Na lauryl sulfate | | | | | 0.8 | 0.3 |
| Na olefin sulfonate | 0.8 | | 1.1 | | | |
| Ethanol | | 5.0 | | | | |
| Isoparaffin | 1.0 | | | | | |
| Water, perfume, preservative to 100% by weight | | | | | | |

The ingredients listed in the Table are the following materials:

Beechwood cellulose powder:

Arbocel B 800×, a product of Rettenmaier, apparent density 105–135 g/l

Urea/formaldehyde resin foam, powdered:

Moist material containing 75% by weight $H_2O$ maximum particle size distribution at around 0.03 mm, apparent density 70 g/l.

Chopped viscose sponge:

Sponge cloth material of the type used for cleaning kitchens (cotton content 50%) was chopped up in a cross-cutting machine into flakes measuring 2.5×2.0×2–8 mm. Apparent density around 90 g/l.

Zeolite agglomerate:

Baylith W 894, granules of zeolite X-Na, binder-free, spherical, particle size 1–4 mm.

Isoparaffin:

Isopar M, a product of Exxon (gasoline), boiling range 205°–255° C.

Cleaners 1 to 6 according to the invention were performance tested against artificial pigment soils and hairy coverings and in regard to the roughening of the treated carpet material and, at the same time, were compared with cleaners which, instead of the rollable particles of viscose sponge or zeolite agglomerate, additionally contained a corresponding quantity of the particular powder-form adsorbent, but were otherwise of the same composition. Cleaning performance against artificial pigment soils was tested on polyamide cut-pile carpets. The cleaners according to the invention showed substantially the same performance as the cleaners without rollable particles. Against hairy coverings (scattered-on mixture of cotton wool, hairs and wool fibers), the cleaners according to the invention were distinctly superior. Whereas, in the case of the Comparison Examples, some of the fibers became trapped in the brush, they wrap themselves around the rollable particles of the cleaners according to the invention and could to be removed with them by vacuum cleaning. The roughening of the carpet material was tested on wool uncut-pile carpets. The carpets treated with the cleaners according to the invention were found on visual examination to show distinctly less roughening than the pieces of carpet treated with the comparison cleaners, i.e. the cleaners without rollable particles.

We claim:

1. A carpet cleaning composition consisting essentially of:

(a) from about 40 to 50% by weight of a powder-form solid adsorbent selected from the group consisting of wood flour, cellulose powder, starch, cork powder, synthetic organic polymers in powder form, silicon dioxide, aluminum oxide in powder form, ground foam glass, fine-particle soluble salts, and mixtures thereof;

(b) from about 0.1 to 2% by weight of flakes of viscose sponge, the flakes having a length of from 3 mm to 10 mm, and a diameter equal to at least 20% of the length;

(c) from about 0.2 to 1.5% by weight of sodium olefin sulfonate;

(d) from about 1 to 10% by weight of a low-aromatic organic solvent; and (e) remainder, water, all weights being based on the total weight of the composition.

2. The composition of claim 1 wherein the powder-form solid adsorbent has a particle size ranging from about 0.01 mm to 1 mm.

3. The composition of claim 1 wherein the flakes of viscose sponge have a macroscopic pore volume of from about 0.3 to 50 ml/g.

4. The composition of claim 1 further comprising an additive selected from the group consisting of organic solvents, anionic surfactants, nonionic surfactants, antistats, optical brighteners, resoiling inhibitors, preservatives, perfumes, and mixtures thereof.

5. The composition of claim 4 wherein the additive is present in the composition in an amount of up to 10% by weight, based on the weight of the composition.

6. A process for cleaning a textile substance comprising:

(a) applying the carpet cleaning composition of claim 1 onto a textile substance;

(b) rubbing said carpet cleaning composition onto the surface of said textile substance; and (c) removing said carpet cleaning composition from said textile substance.

7. The process of claim 6 wherein from 2 to 150 g of the carpet cleaning composition, per square meter of textile to be cleaned is applied onto the textile substance.

8. A process for cleaning a textile substance comprising:

(a) applying the carpet cleaning composition of claim 2 onto a textile substance;

(b) rubbing said carpet cleaning composition onto the surface of said textile substance; and (c) removing said carpet cleaning composition from said textile substance.

9. A process for cleaning a textile substance comprising:

(a) applying the carpet cleaning composition of claim 3 onto a textile substance;

(b) rubbing said carpet cleaning composition onto the surface of said textile substance; and (c) removing said carpet cleaning composition from said textile substance.

10. A process for cleaning a textile substance comprising:

(a) applying the carpet cleaning composition of claim 4 onto a textile substance;

(b) rubbing said carpet cleaning composition onto the surface of said textile substance; and (c) removing said carpet cleaning composition from said textile substance.

11. A process for cleaning a textile substance comprising:

(a) applying the carpet cleaning composition of claim 5 onto a textile substance;

(b) rubbing said carpet cleaning composition onto the surface of said textile substance; and (c) removing said carpet cleaning composition from said textile substance.

* * * * *